US009533336B2

(12) United States Patent
Kume et al.

(10) Patent No.: US 9,533,336 B2
(45) Date of Patent: Jan. 3, 2017

(54) REPAIR DEVICE FOR DENT IN METAL BEND TUBE PART OF MUSICAL INSTRUMENT

(71) Applicant: KUME CORPORATION, Hamamatsu-shi, Shizuoka (JP)

(72) Inventors: Tadashi Kume, Hamamatsu (JP); Shigeru Okada, Hamamatsu (JP)

(73) Assignee: KUME CORPORATION, Hamamatsu (JP)

( * ) Notice: Subject to any disclaimer, the term of this patent is extended or adjusted under 35 U.S.C. 154(b) by 0 days.

(21) Appl. No.: 15/025,472

(22) PCT Filed: Aug. 6, 2014

(86) PCT No.: PCT/JP2014/004098
§ 371 (c)(1),
(2) Date: Mar. 28, 2016

(87) PCT Pub. No.: WO2015/049822
PCT Pub. Date: Apr. 9, 2015

(65) Prior Publication Data

US 2016/0236253 A1 Aug. 18, 2016

(30) Foreign Application Priority Data

Oct. 4, 2013 (JP) ..... 2013-209004

(51) Int. Cl.
*B21D 1/08* (2006.01)
*B21D 1/06* (2006.01)
(Continued)

(52) U.S. Cl.
CPC . *B21D 1/08* (2013.01); *B21D 1/06* (2013.01); *B21D 1/065* (2013.01); *B21D 9/125* (2013.01);
(Continued)

(58) Field of Classification Search
CPC ..... B21D 1/08; B21D 1/065; B21D 1/06; B21D 9/125; G10D 9/00; G10D 7/00; G10D 7/005
(Continued)

(56) References Cited

U.S. PATENT DOCUMENTS 1,429,924 A * 9/1922 Brinkman ..... B21D 9/125 29/890.14
2,085,057 A * 6/1937 Willed ..... B21D 1/08 15/104.08
(Continued)

FOREIGN PATENT DOCUMENTS

JP S58-55420 Y2 12/1983
JP H02-107894 A 4/1990
JP 2009-131890 A 6/2009

OTHER PUBLICATIONS

Nov. 18, 2014 International Search Report issued in International Patent Application No. PCT/JP2014/004098.
(Continued)

*Primary Examiner* — David B Jones
(74) *Attorney, Agent, or Firm* — Oliff PLC

(57) ABSTRACT

Repair device for a dent is provided in metal bend tube part of musical instrument capable of effectively performing repair work in short time, not by conventional repair method using dent ball. In the device, a pressurizing device main body is also provided formed by connecting base member having an L shape in side view with first fulcrum at a base thereof and movable pressurizing member whose upper surface has convex arc-shaped surface in side view and has a second fulcrum at center part of lower surface, through a first and second arm. A wire, passes through the second arm and upright part of base member in axial direction, is provided, stopper is fastened to an end of wire which has passed through to outside of second arm, and wire passes
(Continued)

through inside of curved metal tube and other end side of wire is connected to a foot pressing device.

16 Claims, 2 Drawing Sheets

(51) Int. Cl.
*B21D 9/12* (2006.01)
*G10D 9/00* (2006.01)
*G10G 7/00* (2006.01)
*G10D 7/00* (2006.01)

(52) U.S. Cl.
CPC ..... *G10D 7/005* (2013.01); *G10D 9/00* (2013.01); *G10G 7/00* (2013.01)

(58) Field of Classification Search
USPC ..... 72/466
See application file for complete search history.

(56) References Cited

U.S. PATENT DOCUMENTS 2,345,443 A * 3/1944 Aiken ..... B21D 1/06 72/466
2,545,878 A * 3/1951 Forrest ..... B21D 1/065 29/896.22
4,727,744 A * 3/1988 Ferree ..... B21D 1/065 72/466
4,727,745 A * 3/1988 Ferree ..... B21D 1/08 72/478
7,143,627 B2 12/2006 Akins

OTHER PUBLICATIONS

Nov. 18, 2014 Written Opinion issued in International Patent Application No. PCT/JP2014/004098.

* cited by examiner

REPAIR DEVICE FOR DENT IN METAL BEND TUBE PART OF MUSICAL INSTRUMENT

TECHNICAL FIELD

The present invention relates to a repair device for a brass instrument and a woodwind instrument, in particular, relates to a repair device for a dent in a metal bend tube part of a musical instrument for repairing a dent occurred in a metal bend tube part.

BACKGROUND ART

Brass instruments such as a trumpet and a horn are made of soft metal such as brass. For this reason, if the brass instrument is hit by something or is erroneously dropped, a dent is likely to occur on a circumferential surface of the brass instrument.

Conventionally, as a method for repairing a dent occurred in a metal bend part of a brass instrument or a woodwind instrument, there is a traditional method in which a dent ball and a steel ball are inserted into a dent in a tube, the dent ball is hit by the steel ball by swinging a tube main body, the dent ball is pushed into the dent, and the dent is pushed out to repair the dent. Such a repair method requires substantial time and cost, and also requires skillfulness. Further, for large musical instruments such as a tuba, there is a problem in that it is difficult to swing the tube main body.

As a repair device for solving such problems, Patent Literature 1 discloses, as shown in FIG. 4, a repair device for a brass instrument which is configured such that a steel ball 30 is reciprocated in a tube axis direction by a magnetic field generation device 31, and that a dent ball 32 is pushed into a dent 33 through this reciprocation movement. According to the repair device, it is possible to easily perform repair work without requiring a tube main body 34 to swing.

However, the method is the same as the conventional method in that it is necessary to perform repair work by sequentially exchanging the dent ball from the one having a small diameter to the one having a large diameter. For this reason, it is necessary to prepare a number of dent balls from a small dent ball having a small diameter to a dent ball having a large diameter, and for example, it is necessary to prepare about 80 kinds of dent balls having a different diameter for repairing a tube body having inner diameters of 8 to 30 mm. In addition, electrical equipment is essential. Further, the adjustment of the cycle time and the impact force of the steel ball 30 requires skillfulness.

CITATION LIST

Patent Literature

Patent Literature 1: JP-UM-B-58-55420

SUMMARY OF INVENTION

Technical Problem

An object of the invention is to provide a repair device for a dent in a metal bend tube part of a musical instrument which is capable of effectively performing repair work in a short time, not by a conventional repair method using a dent ball.

Solution to Problem

In order to solve the problem described above, there is provided repair device for a dent in a metal bend tube part of a musical instrument comprising a pressurizing device main body having a base member having an L shape in a side view with a first fulcrum at abase thereof, a movable pressurizing member whose upper surface has a convex arc-shaped surface in a side view and which has a second fulcrum at a center part of a lower surface thereof, a first arm having one end rotatably connected to the first fulcrum and the other end rotatably connected to the second fulcrum, and a second arm having one end rotatably connected to the second fulcrum and the other end slidably fitted into a guide grove which is formed on a horizontal part of the base member and extends in an axial direction, a wire passing through the second arm and an upright part of the base member, a curved metal tube through which the wire, upon extruding from the base member, passes, and a foot pressing device to which the other end side of the wire is connected.

Here, a compression coil spring into which the wire is inserted may be interposed between the upright part of the base member and the second arm.

A ball through which a wire passes may be interposed between the base material and the curved metal tube.

It is preferable that a lower surface of the horizontal part of the base member have a concave arc-shaped surface in a side view along with an inner circumferential surface in an axial direction of a bend tube part to be repaired.

It is preferable that the base member be formed of a non-magnetic material, and the movable pressurizing member be formed of a magnetic material.

Advantageous Effects of Invention

According to the repair device for a dent in a metal bend tube part of a musical instrument of the invention, if the wire is pulled by the foot pressing device being foot-pressed, the second arm is moved by the wire in a direction of the upright part of the base member. Due to this, the first arm also rises in the direction of the upright part, the second fulcrum of the movable pressurizing member is moved in the direction of the upright part and upwardly, and the movable pressurizing member is pushed up upwardly with respect to the base member. Accordingly, the upper surface of the movable pressurizing member pushes up the dent, and the dent is repaired.

In this case, since the wire is operated by the foot pressing operation, the wire can be pulled with a strong force, and the dent can be pushed up with a strong force. Accordingly, it is possible to repair the dent in a short time.

Further, since the large vertical movement amplitude of the movable pressurizing member can be secured, it is possible to complete repair work in a short time without exchanging the pressurizing device main body. Accordingly, it is not necessary to prepare a number of pressurizing device main bodies having a different size.

Moreover, since the wire is operated by the foot pressing operation, an operator can freely use both hands, and it is possible to perform repair work while holding the tube main main body with both hands.

If the compression coil spring into which the wire is inserted is interposed between the upright part of the base member and the second arm, since the second arm is returned to the original position by the compression coil spring when the wire is loosened, the foot pressing operation can be smoothly performed.

If the ball through which the wire passes is interposed between the base member and the curved metal tube, the pressurizing device main body can smoothly swing in a circumferential direction when the pressurizing device main body is inserted into the bend tube part and the movable pressurizing member is positioned right below the dent.

If the lower surface of the horizontal surface of the base member is formed into a concave arc-shaped surface in a side view along with the inner circumferential surface in an axial direction of a bend tube part to be repaired, the movable pressurizing member is supported on the entire lower surface of the base member. Therefore, it is possible to reliably transmit, to the dent, a pressurizing force due to the movable pressurizing member. Further, there is no possibility that the base member deforms a tube main body opposite to the dent.

If the base member is formed of a non-magnetic material and the movable pressurizing member is formed of a magnetic material, by applying the magnet from the outside of the dent, the movable pressurizing member can be positioned at an inner position right under the magnet. Accordingly, it is possible to accurately align the pressurizing device main body with respect to the dent.

DESCRIPTION OF EMBODIMENTS

Figure 1:
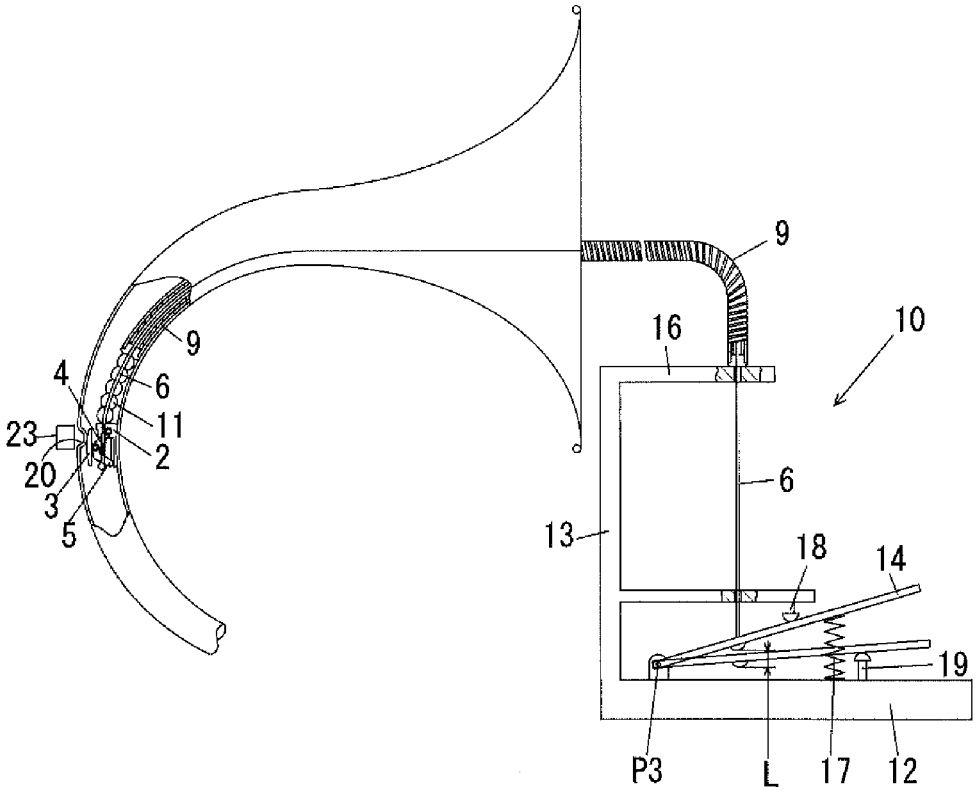
FIG. 1 is a schematic explanatory view of a repair device for a dent in a bend tube part according to an embodiment of the invention.
Figure 2:
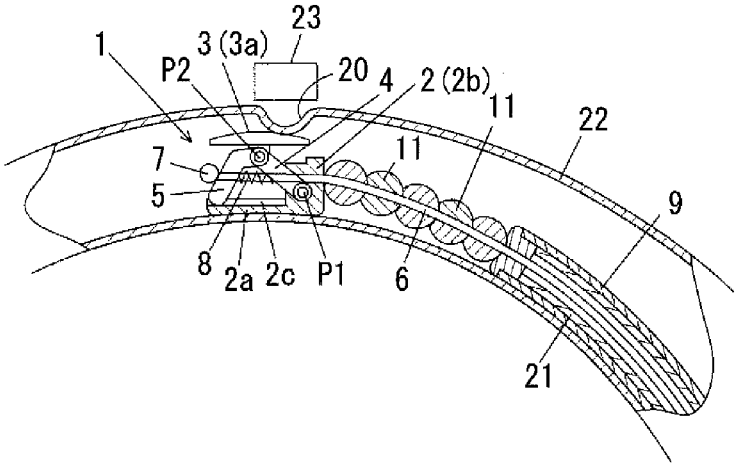
FIG. 2 is an enlarged sectional view of a main part of FIG. 1.
Figure 3:
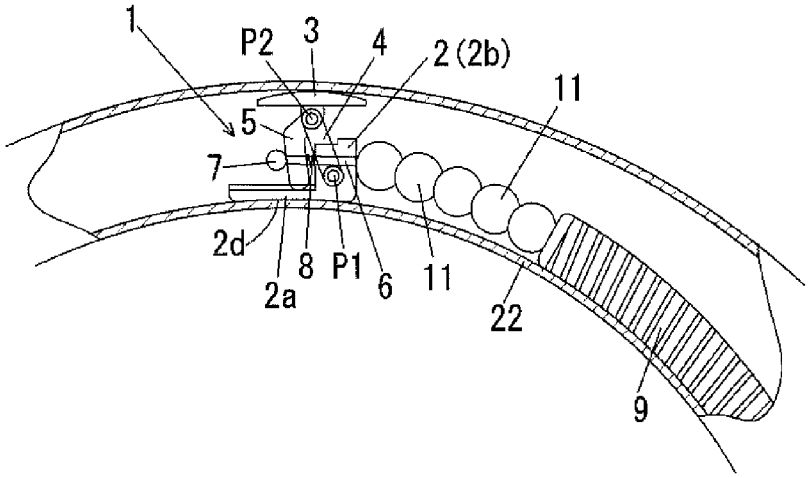
FIG. 3 is an enlarged sectional view corresponding to FIG. 2 showing a state when a wire is foot-pressed.
Figure 4:
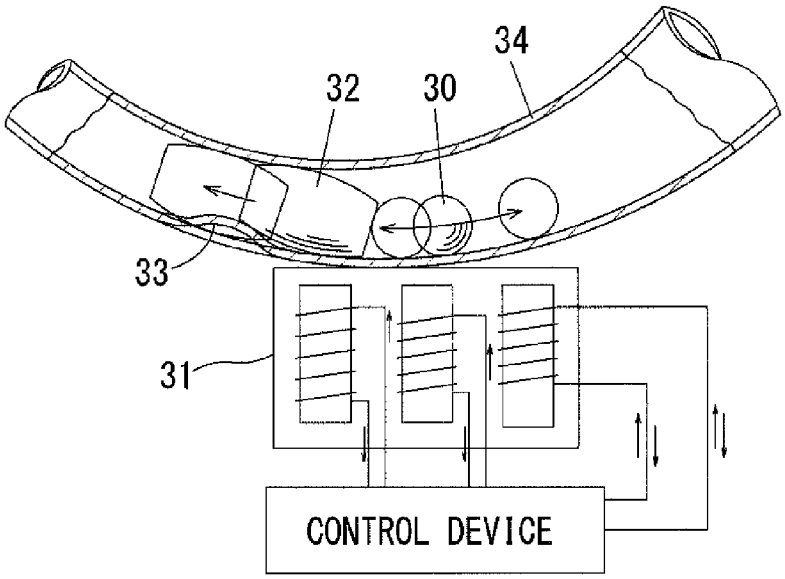
FIG. 4 is a schematic explanatory view of a repair device for a dent in a bend tube part according to a conventional example.

Hereafter, an embodiment for implementing the invention will be specifically described based on the drawings. In FIGS. 1 to 3, reference numeral 1 refers to a pressurizing device main body, and the pressurizing device main body is composed of a base member 2 and a movable pressurizing member 3 and formed by connecting the base member 2 and the movable pressurizing member 3 through a first arm 4 and a second arm 5. The base member 2 has an L shape in a side view and has a first fulcrum P1 at a base thereof. Further, an upper surface 3*a* of the movable pressurizing member 3 has a convex arc-shaped surface in a side view, and a second fulcrum P2 is formed at a center part of a lower surface of the movable pressurizing member 3 in a protruding manner.

The first arm 4 has a straight shape, one end thereof is rotatably connected to the first fulcrum P1 of the base member 2, and the other end thereof is rotatably connected to the second fulcrum P2 of the movable pressurizing member 3. Further, the second arm 5 is formed so as to bend outwardly, one end thereof is rotatably connected to the second fulcrum P2 of the movable pressurizing member 3, and the other end thereof is slidably fitted into a guide groove 2*c* formed in an axial direction on an upper surface of a horizontal part 2*a* of the base member 2.

A through hole is formed in the second arm 5 in an axial direction, and a wire 6 is inserted into the through hole. A stopper 7 is fastened to an end where the wire 6 passes through the through hole. Further, a through hole into which the wire 6 is inserted in an axial direction is formed in an upright part 2*b* of the base member 2. Then, a compression coil spring 8 into which the wire 6 is inserted is interposed between the second arm 5 and the upright part 2*b* of the base member 2.

The other end side of the wire 6 is inserted into a curved metal tube 9, and is connected to a foot pressing device 10.

A ball 11 into which the wire 6 is inserted is interposed between the upright part 2*b* of the base member 2 and one end side of the curved metal tube 9. In FIGS. 1 to 3, five balls 11 are arranged in series. However, the number of balls is arbitrary, and even one ball is sufficient.

As shown in FIG. 1, the foot pressing device 10 is composed of a base 12, a support 13 fixed on the base in an upright manner, a footboard 14 vertically swingably supported on the base, and the like.

The other end side of the curved metal tube 9 is supported on a shelf board 16 provided at the top of the support 13 that is fixed on the base in an upright manner, the other end side of the wire 6 which is inserted into the curved metal tube 9 is fixed to the footboard 14. The footboard 14 is vertically swingably supported with a third fulcrum P3 on the base as a center. The footboard 14 is pushed up upwardly by a compression coil spring 17 interposed between a lower surface of the footboard 14 and the upper surface of the base. Reference numerals 18 and 19 refer to stoppers for regulating the vertical movement of the footboard 14. By adjusting the vertical positions of the stoppers 18 and 19, it is possible to adjust a stroke (movement distance) L of the wire 6 when the footboard 14 is foot-pressed.

By the footboard 14 being foot-pressed, the wire 6 is pulled downwardly by the length L. As a result of this, the wire 6 on a pressurizing device main body 1 side is also pulled in an axial direction by the length L. Due to this, the second arm 5 is moved by the wire 6 in a direction of the upright part 2*b* of the base member 2. In this case, the first arm 4 also rises in the direction of the upright part 2*b*, the second fulcrum P2 of the movable pressurizing member 3 moves in the direction of the upright part 2*b* and upwardly, and the movable pressurizing member 3 is pushed up upwardly with respect to the base ember 2. Due to this, the upper surface 3*a* of the movable pressurizing member 3 pushes up a dent 20 upwardly, and thereby the dent 20 is repaired.

In this case, since the wire 6 is operated by foot pressing, an operator can freely use both hands. For this reason, it is possible for the operator to smoothly perform repair work while freely using both hands.

It should be noted that it is sufficient for the foot pressing device 10 to be capable of pulling the wire 6 by a predetermined length through a foot pressing operation of the footboard 14, and the structure thereof is not limited to that shown in FIG. 1.

The wire 6 is inserted into an elastic wire tube 21, and further, the wire tube 21 is fitted into the curved metal tube 9. Since both of the wire tube 21 and the curved metal tube 9 have an elastic property, the pressurizing device main body 1 connected by the wire 6 can be smoothly inserted to the dent 20.

By using the curved metal tube 9, even if the wire 6 is strongly pulled by the foot pressing device 10, the wire tube 21 is not curved, and it is possible to transmit a strong tensile force to the wire 6 on a pressurizing device main body 1 side.

Since the pressurizing device main body 1 is not fixed to the curved metal tube 9 and the ball 11, when the pressurizing device main body 1 is inserted into the bend tube part 22, the movable pressurizing member 3 is usually inserted into the dent 20 in a state in which the movable pressuring member 3 is inclined in a circumferential direction of the bend tube part 22. Then, when a magnet 23 is arranged on the outside of the dent 20 and the movable pressurizing member 3 is moved to a position right under the dent 20, the pressurizing device main body 1 can smoothly swing in a circumferential direction because the ball 11 is interposed between the base member 2 and the curved metal tube 9 and because the resistance thereof is small.

The movable member 3 is formed of a magnetic material (made of steel) acting with the magnet 23. On the other hand, the base member 2 (2*a*) is formed of a non-magnetic material (made of stainless) not acting with the magnet 23. Due to this, by arranging the magnet 23 on the outside of the dent 20, it is possible to easily position the movable pressurizing member 3 of the pressurizing device main body 1 at a position right under the dent 20.

Further, since the dent 20 is often formed on the circumferential surface of the bend tube part on a convex side, a lower surface 2*d* of the base member 2 is formed into a gradual convex arc-shaped surface along with an arc-shaped surface of the tube body 22 in an axial direction. Accordingly, the movable pressurizing member 3 is supported on the entire lower surface 2*d* of the base member 2.

Since the movable pressurizing member 3 is firmly supported on the base member 2 by the first arm 4 and the second arm 5, by strongly pulling the wire 6, it is possible to push up the movable pressurizing member 3 upwardly with a strong force. For this reason, it is possible to push up the dent 20 with a strong force and to repair the dent 20 in a short time. Further, since the wire 6 is pulled by foot pressing, it is possible to smoothly perform repair work while freely using both hands. Further, it is possible to complete the repair of the dent 20 without exchanging the pressurizing device main body 1, and thereby completing the repair in a very short time.

Next, the procedures for repairing the dent 20 occurred on the metal bend tube part 22 of the musical instrument will be explained. At first, the stroke (L) of the wire 6 is adjusted by the foot pressing device 10 in advance according to the size, depth and the like of the dent 20. Next, the curved metal tube 9 on which the pressurizing device main body 1 is mounted at the end thereof is inserted toward the dent 20 of the metal bend tube part 22 of the musical instrument. In this case, by arranging the magnet 23 on the outside of the dent 20, the movable pressurizing member 3 of the pressurizing device main body 1 is positioned at a position right under the dent 20.

Then, the footboard 14 of the foot pressing device 10 is pressed with the foot to pull the wire 6. Due to this, the wire 6 on a pressurizing device main body 1 side is pulled, and the second arm 5 is moved rightward in FIG. 2. As a result of this, the second fulcrum P2, that is, the movable pressurizing member 3 is pushed upwardly with respect to the base member 2, and the dent 20 is repaired by pushing up the dent 20 upwardly (FIG. 3).

In this case, if the vertical movement amplitude of the movable pressurizing member 3 corresponds to the depth of the dent 20, it is possible to perform repair work without exchanging the pressurizing device main body 1, and thereby completing the repair in a very short time. In this way, the large vertical movement amplitude of the movable pressurizing member 3 can be secured. Therefore, it is possible to effectively perform repair work. For this reason, it becomes unnecessary to prepare a number of pressurizing device main bodies having a different size. In a conventional repair method by hitting a dent ball using a steel ball, it takes 2 to 3 hours to complete the repair work. In contrast, in repair work using the device according the embodiment, it takes about 10 to 20 minutes to complete the repair work. Further, it is possible to easily perform repair work without requiring skillfulness.

According to the repair device according to the invention, since the wire 6 is pulled by foot pressing, the wire can be pulled with a strong force. For this reason, it is possible to push up the movable pressurizing member 3 upwardly with a strong force, and the dent 20 can be repaired in a short time by pushing up the dent 20. Accordingly, the burden of repair work is significantly reduced compared to the conventional repair work.

Further, according to the repair device of the invention, since electricity is not necessary, it is possible to perform repair work at a place where electrical equipment is not provided.

REFERENCE SIGNS LIST

1 . . . pressurizing device main body, 2 . . . base member, 2*a*, . . . horizontal part, 2*b* . . . upright part, 2*c* . . . guide groove, 2*d* . . . lower surface, 3 . . . movable pressurizing member, 3*a* . . . upper surface, 4 . . . first arm, 5 . . . second arm, 6 . . . wire, 7 . . . stopper, 8 . . . compression coil spring, 9 . . . curved metal tube, 10 . . . foot pressing device, 11 . . . ball, 12 . . . base, 13 . . . support, 14 . . . footboard, 16 . . . shelf board, 17 . . . compression coil spring, 18, 19 . . . stopper, 20 . . . dent, 21 . . . wire tube, 22 . . . bend tube part, 23 . . . magnet, P1 . . . first fulcrum, P2 . . . second fulcrum, P3 . . . third fulcrum, L . . . stroke

The invention claimed is:

1. A repair device for a dent in a metal bend tube part of a musical instrument comprising:

a pressurizing device main body including:

a base member that includes:

a base and that forms an L shape in a side view, and a first fulcrum at a horizontal part of the base member;

a movable pressurizing member that includes:

an upper surface with a convex arc-shaped surface in a side view, a lower surface, and a second fulcrum at a center part of the lower surface;

a first arm having one end rotatably connected to the first fulcrum and another end rotatably connected to the second fulcrum, and a second arm having one end rotatably connected to the second fulcrum and another end slidably fitted into a guide grove which is formed on the horizontal part of the base member and extends in an axial direction, a wire passing through the second arm and an upright part of the base member, a curved metal tube through which the wire, upon extruding from the base member, passes, and a foot pressing device that is connected to an end side of the wire.

2. The repair device for a dent in a metal bend tube part of a musical instrument according to claim 1, wherein a compression coil spring into which the wire is inserted is interposed between the upright part of the base member and the second arm.

3. The repair device for a dent in a metal bend tube part of a musical instrument according to claim 1, wherein a ball through which the wire passes is interposed between the base member and the curved metal tube.

4. The repair device for a dent in a metal bend tube part of a musical instrument according to claim 1, wherein a lower surface of the horizontal part of the base member has a convex arc-shaped surface in a side view along with an inner circumferential surface in an axial direction of a bend tube part to be repaired.

5. The repair device for a dent in a metal bend tube part of a musical instrument according to claim 1, wherein the base member is formed of a non-magnetic material, and the movable pressurizing member is formed of a magnetic material.

6. The repair device for a dent in a metal bend tube part of a musical instrument according to claim 2, wherein a ball through which the wire passes is interposed between the base member and the curved metal tube.

7. The repair device for a dent in a metal bend tube part of a musical instrument according to claim 2, wherein a lower surface of the horizontal part of the base member has a convex arc-shaped surface in a side view along with an inner circumferential surface in an axial direction of a bend tube part to be repaired.

8. The repair device for a dent in a metal bend tube part of a musical instrument according to claim 3, wherein a lower surface of the horizontal part of the base member has a convex arc-shaped surface in a side view along with an inner circumferential surface in an axial direction of a bend tube part to be repaired.

9. The repair device for a dent in a metal bend tube part of a musical instrument according to claim 6, wherein a lower surface of the horizontal part of the base member has a convex arc-shaped surface in a side view along with an inner circumferential surface in an axial direction of a bend tube part to be repaired.

10. The repair device for a dent in a metal bend tube part of a musical instrument according to claim 2, wherein the base member is formed of a non-magnetic material, and the movable pressurizing member is formed of a magnetic material.

11. The repair device for a dent in a metal bend tube part of a musical instrument according to claim 3, wherein the base member is formed of a non-magnetic material, and the movable pressurizing member is formed of a magnetic material.

12. The repair device for a dent in a metal bend tube part of a musical instrument according to claim 6, wherein the base member is formed of a non-magnetic material, and the movable pressurizing member is formed of a magnetic material.

13. The repair device for a dent in a metal bend tube part of a musical instrument according to claim 4, wherein the base member is formed of a non-magnetic material, and the movable pressurizing member is formed of a magnetic material.

14. The repair device for a dent in a metal bend tube part of a musical instrument according to claim 7, wherein the base member is formed of a non-magnetic material, and the movable pressurizing member is formed of a magnetic material.

15. The repair device for a dent in a metal bend tube part of a musical instrument according to claim 8, wherein the base member is formed of a non-magnetic material, and the movable pressurizing member is formed of a magnetic material.

16. The repair device for a dent in a metal bend tube part of a musical instrument according to claim 9, wherein the base member is formed of a non-magnetic material, and the movable pressurizing member is formed of a magnetic material.

* * * * *